United States Patent [19]

Waters

[11] Patent Number: 5,001,847

[45] Date of Patent: Mar. 26, 1991

[54] LACE FASTENER

[76] Inventor: William A. Waters, 3648 E. 49th St., Tulsa, Okla. 74135-3102

[21] Appl. No.: 323,413

[22] Filed: Mar. 14, 1989

[51] Int. Cl.[5] ..... A43B 11/00

[52] U.S. Cl. ..... 36/50; 24/191; 24/712.6

[58] Field of Search ..... 36/50; 24/117, 120, 24/121, 170, 191, 538–541

[56] References Cited

U.S. PATENT DOCUMENTS

| | | | |
|---|---|---|---|
| 831,585 | 9/1906 | Weld | 24/540 |
| 1,362,970 | 12/1920 | Tanguay | 24/117 |
| 1,616,694 | 2/1927 | Hoppe | 24/120 |
| 1,703,689 | 2/1929 | Okrainete et al. | 24/117 |
| 1,730,462 | 10/1929 | Jaques | 24/117 |
| 2,160,897 | 6/1939 | Oliver | 24/540 |
| 3,108,385 | 10/1963 | Teufel | 36/50 |
| 3,290,745 | 12/1966 | Maxwell et al. | 24/120 |

FOREIGN PATENT DOCUMENTS

| | | | |
|---|---|---|---|
| 1031930 | 6/1953 | France | 24/541 |
| 184860 | 9/1936 | Switzerland | 24/541 |
| 336216 | 3/1959 | Switzerland | 24/541 |

*Primary Examiner*—Steven N. Meyers
*Attorney, Agent, or Firm*—Head & Johnson

[57] ABSTRACT

A lace fastener has upper and lower jaws and a latch to selectively hold the jaws in their closed position. The lower jaw has an opening through which the lace is inserted into the fastener. The upper jaw is arced so that, in the closed position, the up sides of the jaws form an elliptical opening. The teeth of the jaws are curved slightly inwardly to accentuate the elliptical relationship and are in an underbite relationship. A plurality of fasteners may be fixed with their lower jaw openings aligned with selected eyelets or other form of laceholder so that a lace can be fed in normal criss-cross fashion through the laceholder. The lace can then be tautened, even with the latches closed, by drawing it through the opening in the lower jaw and out the elliptical up side opening. The lace is secured in the taut position by closing the latches with the lace between the teeth of the fastener. A bow knot may be used, but is not required. The fastener may be similarly used in conjunction with strings, cords, lines, straps and the like.

3 Claims, 2 Drawing Sheets

LACE FASTENER

BACKGROUND

This invention relates generally to fasteners for laces, straps and the like and more particularly concerns latch type fasteners for rapidly securing and releasing them.

The problem of securing and maintaining laces or similar items such as strings, cords and lines in a taut condition and preventing their inadvertent untying has continued for as long as laces have existed. In use, both the laced material, be it a tow sack or gunnysack, a duffel bag, a canvas cover or tarpaulin or leather or canvas shoes or any similar article, and the lace itself gradually stretch and loosen and, eventually, the securing bow-knot itself loosens or even becomes untied. And these difficulties only accentuate the impossibility of obtaining a truly taut condition of the lace in the first place. For example, tautness in a shoe lace is generally lost in the process of pulling the lace through to the top level of eyelets and then attempting to tie the lace while trying to maintain what tautness has been achieved. The problem takes on greater significance in relation to athletic footwear where snugness of footwear sometimes bears directly on an athlete's level of performance.

similar difficulties are encountered with respect to the buckling device presently used to secure belts and straps associated with articles of clothing and various types of containers, such as boxes or luggage.

Many fasteners intended to resolve this general problem have been designed since the turn of the century.

One type of fastener, many variations of which exist, clamps a bow-knot tied in a lace by gripping the bow and free portions of the lace. Thus, the knot cannot be inadvertently undone. This type of fastener relies on the knot to secure the lace in its taut condition, and the fastener merely secures the knot. It requires not only the tying of a knot in as taut a condition as possible but also the arrangement and holding of the bow and free portion of the lace in position in the fastener during the securing operation. This is time consuming and still leaves the tautness of the lace dependent upon the security of the knot. Fasteners of this type are also generally of cumbersome size and unsightly appearance, particularly in today's fashion conscious market, even with respect to athletic footwear.

Other fasteners have been designed of more streamlined and suitable appearance than the bow-knot type, but they generally are intended to grip a garment and do not allow or provide for the drawing of any lace or strap through the fastener into the taut position.

Another difficulty with many of these fasteners is that they accomplish the gripping function by use of prongs which penetrate the gripped material, thereby causing excessive wear and damage to it.

SUMMARY

In view of the foregoing difficulties, the present fasteners is designed to grip the taut portion of a lace or strap directly. The lace or strap is thus held in taut position by the fastener itself and no knot is necessary. Another object of this fastener is to permit securing and maintaining the lace or strap in as taut a condition as possible and in rapid fashion. It is also an object of this fastener to provide for the rapid release of the lace or strap for easy loosening of the laced or strapped article. In accordance with the invention, a fastener which has a pair of jaws for gripping a lace or strap is provided. The lower jaw has an aperture through which the lace or strap may be drawn to either fasten or loosen the lace or strap. The upper jaw is selectively flexed by an articulating latch into and out of occulation with the lower jaw to either grip or release the lace or strap. One side of the jaws, in conjunction with the aperture, forms a path through which the lace or strap may be freely drawn, even when the jaws are closed. To protect the lace or strap against wear or damage, the teeth of the jaws are rounded and curved slightly inwardly and the occlusion of the teeth is offset. When a plurality of fasteners are employed at different eyelet levels on a shoe, a sequential tauteninng and latching process affords maximum tautness of the lace.

BRIEF DESCRIPTION OF THE DRAWINGS

Other objects and advantages of this invention will become apparent upon reading the following detailed description and upon reference to the drawings in which:

FIG. 5 is a perspective view of a preferred embodiment of the invention used to fasten a duffel bag or the like.

DETAILED DESCRIPTION

The fastener herinafter described is effective for securing laces or straps used in binding various articles of manufacture.

Figure 1:
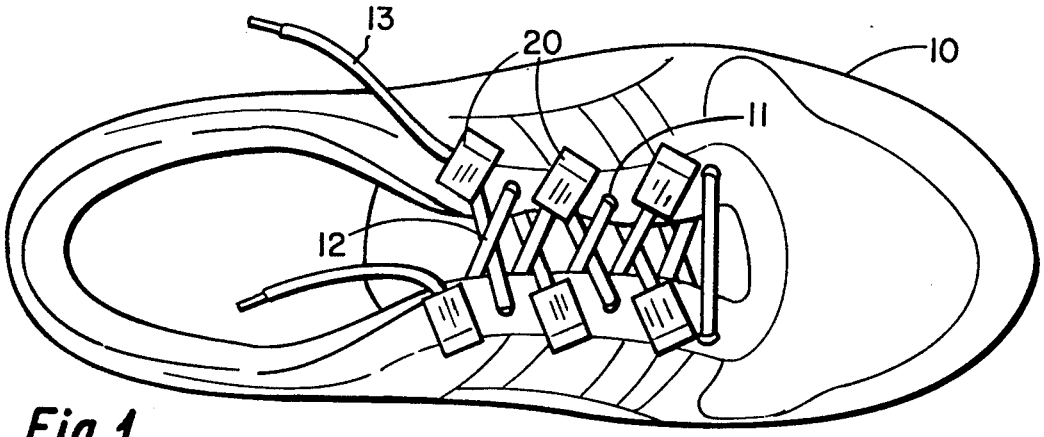
FIG. 1 is a top perspective view illustrating use of a plurality of a preferred embodiment of the invention with an athletic shoe.

Referring to FIG. 1, use of the fastener is illustrated in relation to a typical laced athletic shoe 10 which has a plurality of ringed eyelets 11 through which a lace 12 is threaded in criss-cross fashion from the lower to the upper eyelets. The fastener could be used as well with bail-type lace holders such as D-rings or hooks rather than eyelets.

As shown, the fastners 20 of the present invention are fixed to the shoe 10 proximate its first, third and fifth eyelets. More or fewer fasteners can be used, in the discretion of the wearer, but it is recommended that fasteners be used at the upper eyelets and usually at one or more other levels of eyelet as well, perhaps alternately.

Figure 2:
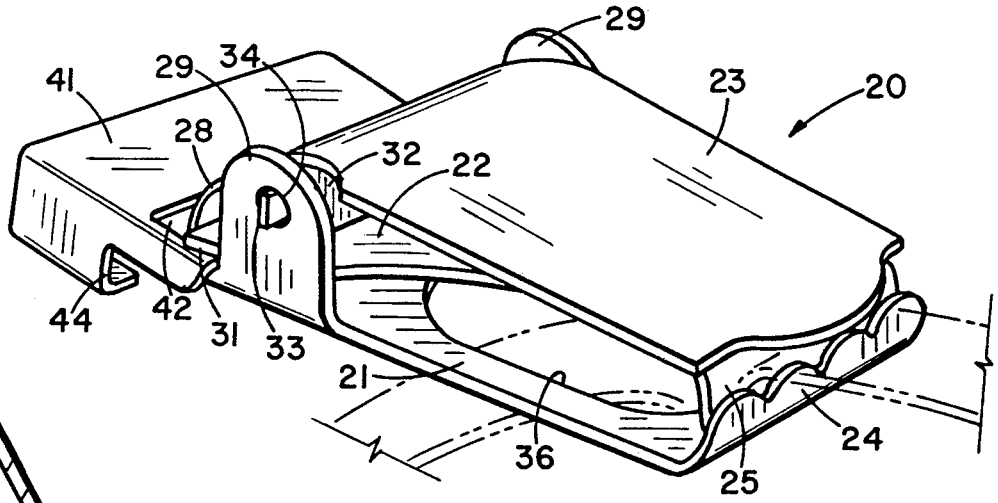
FIG. 2 is a side perspective view of a preferred embodiment of the invention in the closed position.
Figure 3:
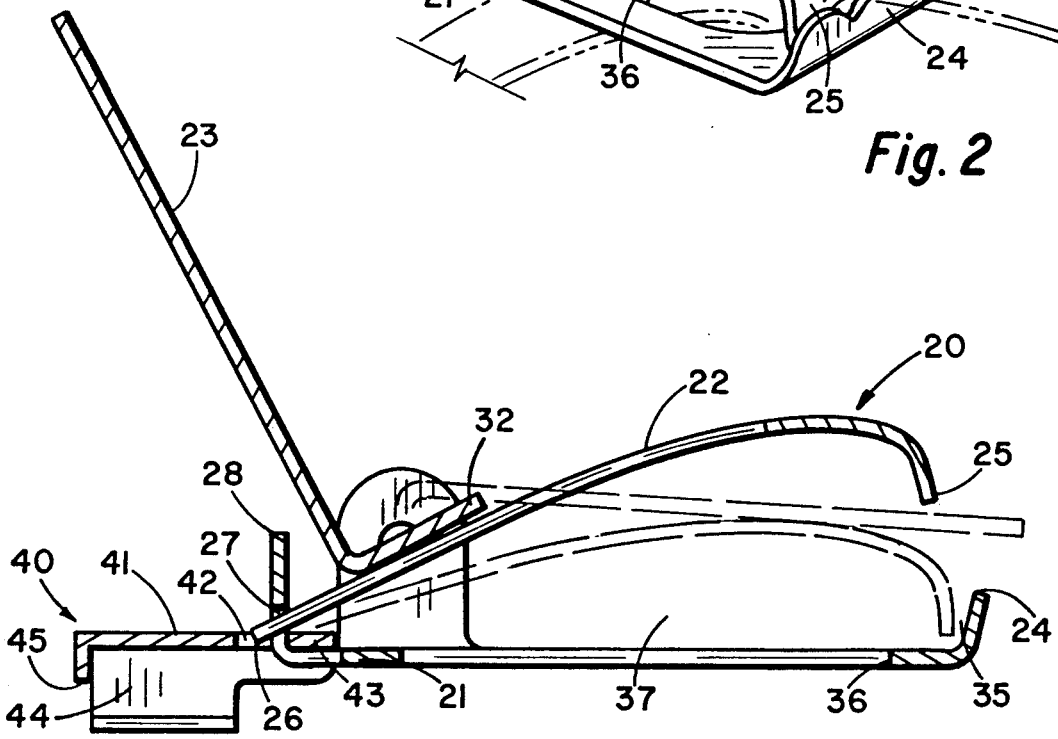
FIG. 3 is a longitudinal central sectional view of a preferred embodiment of the invention in the open position also showing the closed position in dotted lines.

The fastener 20 has a lower jaw 21, an upper jaw 22 and a latching member 23, shown in the closed position in FIG. 2. The lower jaw 21 is a base plate with an upwardly turned flange 24 along its free end forming the teeth of the lower jaw. The upper jaw 22 consists of a leaf spring with a downwardly turned flange 25 along its free end forming the teeth of the upper jaw. The jaws 21 and 22 are fixed to each other in any suitable manner at their other ends so that they freely rest in the open position as shown in FIG. 3. As shown, a tongue 26 extending from the end of the upper jaw 21 is inserted in a slot 27 provided in an upwardly turned flange 28 along the end of the lower jaw 21. This arrangement holds the jaws in their proper vertical attitude. A pair of ears 29 extending upwardly from the sides of the lower jaw 21 cooperate with the flange 28 to form a pair of seats 30. Tabs 31 extending outwardly from the sides of the upper jaw 22 rest in the seats 30 and fix the horizontal attitude of the jaws.

The latching member 23 is a rigid plate having a flange 32 along one of its ends with a pair of pins 33 extending from the sides of the flange 32. The pins 33 are journalled in holes 34 provided in the ears 29 so that the latching member 23 can be selectively pivoted in and out of the closed position as shown in FIG. 3. In the closed position, the edge of the flange 32 bears down upon the upper surface of the leaf spring 22 to close the jaws and bring the teeth 24 and 25 into occlusion. As shown in the preferred embodiment of FIGS. 2 and 3, the teeth are arranged for offset occlusion providing an underbite 35.

The lower jaw 21 has an aperture 36 through which the lace 12 is fed from the eyelet 11, or other laceholder, into the fastener 20. The upper jaw 22 arcuately extends from its fixed end toward its teeth 25 so as to form a somewhat elliptical opening 37 in one side of the jaws when they are closed. The teeth on both jaws may be slightly inwardly curved to accentuate this relationship.

The fastener 20 may be secured to the shoe 10 in any suitable fashion, such as by the clamp 40. The clamp 40 consists of a plate 41 with a slot 42 forming a shelf 43. When the flange 28 of the lower jaw 21 is inserted in the slot 42 with the shelf 43 pressed between the fixed ends of the jaws, the fastener 20 is cantilevered from the clamp 40. The clamp 40 is then fixed to the shoe 10 by bending tabs 44 on the sides of the clamp to compress and hold the shoe material against a toothed flange 45 along the back of the clamp.

In operation, each fastener 20 is fixed to the shoe 10 with its aperture 36 aligned with a selected shoe eyelet 11. Each fastener 20 is aligned so that the teeth of its jaws will transverse to the path of the criss-crossed lace 12 when the lace 12 is tautly drawn through the fastener 20. The fastener 20 therefore lies at approximately a 45° angle toward the wearer. The side of the jaws which forms the elliptical opening 37 is disposed on the up or wearer side of the lace 12. The lace 12 is fed through each eyelet 11 and its respective fastener aperture 36 in the normal lacing fashion. With the fastener latches 23 open, the lace 12 may be tautly drawn and positioned between the jaws if not already in this position. The latches may then be snapped closed to secure the lace 12 in the taut position between the jaws 21 and 22. Maximum lace tightness can be achieved by sequential drawing and securing of the lace 12 in consecutive fasteners 20 proceeding from the lower to the upper eyelets 11 of the shoe 10. Even with the latches 23 and jaws 21 and 22 closed, the lace 12 may be freely drawn to a taut condition in the fastner 20 prior to moving the lace 12 between the jaws 21 and 22 for locking along the path defined by the aperture 36 and the up side elliptical opening 37, as shown with respect to the upper eyelet at one lace end 13 in FIG. 1.

The fasteners 20 may be used in lieu of, rather than in conjunction with, conventional lace holders, since the apertures 36 or the combination of the apertures 36 and the side opening 37 in the fasteners 20 may also serve the function of the shoe eyelet 11 or bail-type lace holders.

Figure 4:
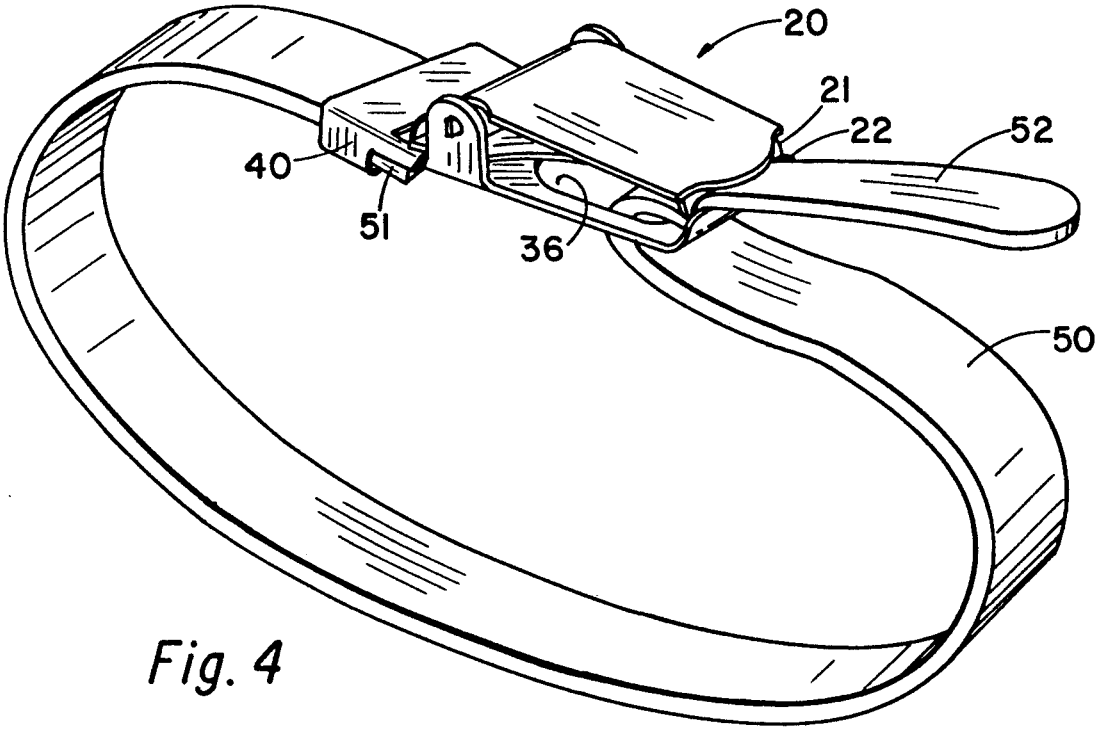
FIG. 4 is a perspective view of a preferred embodiment of the invention used with a strap or belt.

As shown in FIG. 4, the fastner 20 will also be seen to be readily usuable with a strap or belt 50 rather than a lace, with one end 51 of the strap secured in the clamp 40, the strap wrapped around the article to be secured and the other end 52 of the strap fed through the aperture 36 and then back between the teeth of the jaws 21 and 22. Of course, this fastener 20 could be secured to the article, such as luggage, and one end of the strap also fastened to the luggage with the free and inserted into the fastener.

Figure 5:
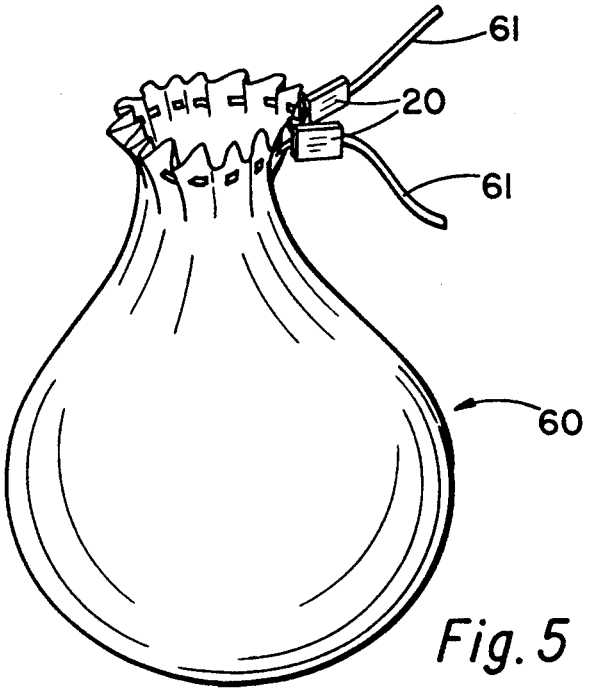

The use of the fastener 20 in securing the cords 61 of a duffel bag 60 is illustrated in FIG. 5. The fastener 20 are fixed to the bag 60 with the fastener operative 36 aligned with the duffel bag grommets (not shown).

It will be apparent to those skilled in the art that many alternatives may be chosen and modifications made in the invention herein described without departing from the scope of the invention. Accordingly, it is intended that the scope of invention include all such alternatives and modifications as are apparent from the description or drawings or the appended claims.

What is claimed is:

1. In combination with footwear having a plurality of laceholders through which a shoestring is interlaced, a plurality of fasteners, each of said fasteners comprising a lower base plate, an intermediate leaf spring and an upper latch, said base plate having an aperture therin, an upwardly turned serrated flange at one of its ends and means for securing said base plate to said footwear with said aperture in alignment with one of said laceholders and said flange transverse to and in the path of said shoestring, said leaf spring being fixed at one end to said base plate and arcuately extending to a downwardly turned serrated flange disposed along its free end for offset occlusion with said plate flange, said serrated flanges being cooperable with said base plate and said arcuate extension to form a somewhat elliptical opening in an up side of said jaws, said latch being hinged to said baseplate and having means disposed therein for releasably bearing on said leaf spring to bring said serrated flanges into offset occlusion in its closed position, said shoestring being threaded into said fastener through said laceholder and said aperture and out of said fastener selectively either through said somewhat elliptical up side opening for free drawing of the string or between the serrated flanges for securing of the string when the latch is closed.

2. The combination according to claim 1 wherein a fastener aligned with an uppermost and of said laceholders is disposed at approximately a 45° angle toward the wearer.

3. For footwear having laces fed in criss-cross fashion through laceholders distributed from the lower to the upper portion of the footwear, a method for tautly lacing the footwear comprising the steps of sequentially securing segments of lace from lower levels of laceholders to upper levels of laceholders, each of said securing steps coming comprising the sub-steps of:

pulling a segment of the lace tautly through one or more levels of laceholders;

extending the upper portions of the tautly pulled segment of lace between the teet of an open pair of jaws;

closing said jaws on said upper portion of said lace segment to secure the portion of said segment below said teeth in the taut condition.

* * * * *